US011661247B2

(12) United States Patent
Ingram et al.

(10) Patent No.: US 11,661,247 B2
(45) Date of Patent: May 30, 2023

(54) PRODUCT PACKAGING AND LOCKING MECHANISMS

(71) Applicant: Veritiv Operating Company, Sandy Springs, GA (US)

(72) Inventors: Logan Ingram, Chandler, AZ (US); Grant LaPierre, Scottsdale, AZ (US)

(73) Assignee: VERITIV OPERATING COMPANY, Sandy Springs, GA (US)

( * ) Notice: Subject to any disclaimer, the term of this patent is extended or adjusted under 35 U.S.C. 154(b) by 38 days.

(21) Appl. No.: 17/235,211

(22) Filed: Apr. 20, 2021

(65) Prior Publication Data

US 2021/0371170 A1 Dec. 2, 2021

Related U.S. Application Data

(60) Provisional application No. 63/031,976, filed on May 29, 2020.

(51) Int. Cl.
*B65D 43/22* (2006.01)

(52) U.S. Cl.
CPC ..... *B65D 43/22* (2013.01); *B65D 2251/1033* (2013.01); *B65D 2543/00287* (2013.01)

(58) Field of Classification Search
CPC ..... B65D 2251/1058; B65D 50/04; B65D 2215/02; B65D 2251/1025; B65D 43/22; B65D 2251/1033; B65D 2543/00287; A45C 11/20
See application file for complete search history.

(56) References Cited

U.S. PATENT DOCUMENTS

| | | | | |
|---|---|---|---|---|
| 4,344,646 | A * | 8/1982 | Michel | E05B 65/5276 292/87 |
| 9,106,061 | B1 * | 8/2015 | Shotey | E05B 15/024 |
| 2012/0211493 | A1 * | 8/2012 | Daggett | B65D 43/22 206/508 |
| 2014/0263348 | A1 * | 9/2014 | Liistro | B65F 1/002 220/531 |
| 2015/0366755 | A1 * | 12/2015 | Milante | B65D 43/0218 215/203 |
| 2016/0023816 | A1 * | 1/2016 | Giraud | B65D 43/22 53/485 |

* cited by examiner

*Primary Examiner* — Shawn M Braden
(74) *Attorney, Agent, or Firm* — Kilpatrick Townsend & Stockton LLP

(57) ABSTRACT

A product package assembly may include a first member that is coupleable to a second member via a molded fiber locking mechanism. The locking mechanism may include a body portion, a pair of end portions, and neck portions that are positioned between each of the end portions and the body portion. The locking mechanism may be repeatedly moveable between a locked position, in which the first member is coupled to the second member in a closed position, and an actuated position, in which the first member is uncoupled from the second member for rotating the first member away from the second member to position the product package in an open position. The locking mechanism may be formed of fiber materials.

26 Claims, 7 Drawing Sheets

PRODUCT PACKAGING AND LOCKING MECHANISMS

CROSS REFERENCE TO RELATED APPLICATIONS

This application is a claims the benefit of priority to U.S. Provisional Application Ser. No. 63/031,976, titled "MOLDED FIBER LOCK" and filed May 29, 2020, the entire contents of which is hereby incorporated by reference.

FIELD OF THE INVENTION

This application relates to product packaging, and more specifically but not exclusively, to locking mechanisms for product packaging.

BACKGROUND

Conventional product packaging often contains non-sustainable materials, including but not limited to plastic. In particular, locking mechanisms used in product packaging often comprise plastic. As such, the product package often includes parts comprising fiber materials and part comprising non-fiber materials that may require manual separation of the various parts of the package prior to recycling. For example, a product package may comprise a fiber material while a locking mechanism may comprise a plastic material such that the plastic material must be separated from the package for separate recycling. Moreover, conventional product packaging often has to be specially manufactured to be compatible with existing locking mechanisms.

BRIEF SUMMARY OF THE INVENTION

According to certain embodiments, a product package may include a locking mechanism comprising a material that may be recycled along with the material of the remaining product package. For example, the locking mechanism may comprise materials such that the entire package (including the locking mechanism) may be recycled together without manual separation of the parts. In some embodiments, a locking mechanism for a product package may be moveable between a locked (or unactuated) position and an unlocked (or actuated) position for optionally repeatedly moving the product package between an open position and a closed position in which the product package is secure in the closed position. The locking mechanism may include a body portion, a pair of end portions, and a pair of neck portions extending between the body portion and each respective end portion. The body portion of the locking mechanism may extend from or through an opening in a first wall of the product package. The body portion may be sized and shaped to extend through a second opening in a second wall of the product package to secure the product package in a closed position when the locking mechanism is in the locked or unactuated position. The locking mechanism may secure the product package in the closed position by coupling the first wall and the second wall together. The locking mechanism may be forced or moved into an unlocked or actuated position in which a portion of the locking mechanism disengages or uncouples from the second opening in the second wall of the product package to allow for moving the product package from the closed position into the open position.

In some embodiments, the locking mechanism may be formed of fiber materials, including but not limited to molded fiber materials. In some embodiments, the locking mechanism may comprise a sustainable fiber material. The locking mechanism may be biodegradable, compostable and/or recyclable. As used herein, the term "biodegradable" means being capable of being decomposed or experiencing biodegradation by bacteria or other living organisms. The locking mechanism may not include plastic materials.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim. Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups. In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Figure 1B:
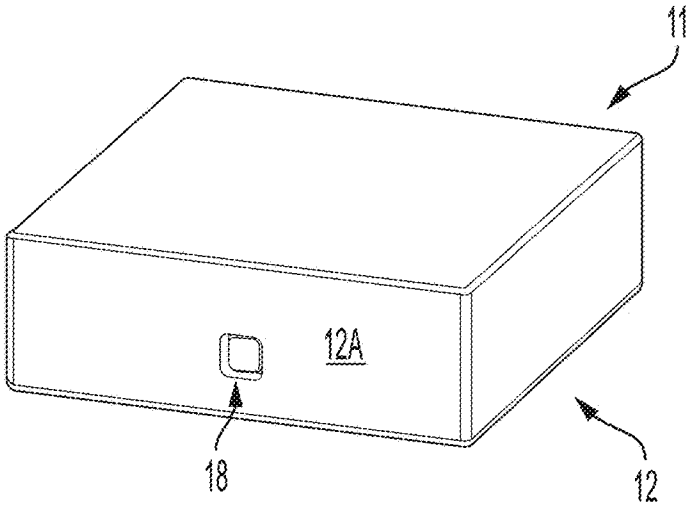
FIG. 1B is a perspective view of the product package with the locking mechanism of FIG. 1A, the locking mechanism of the present disclosure actuated into the unlocked or actuated position.
Figure 1A:
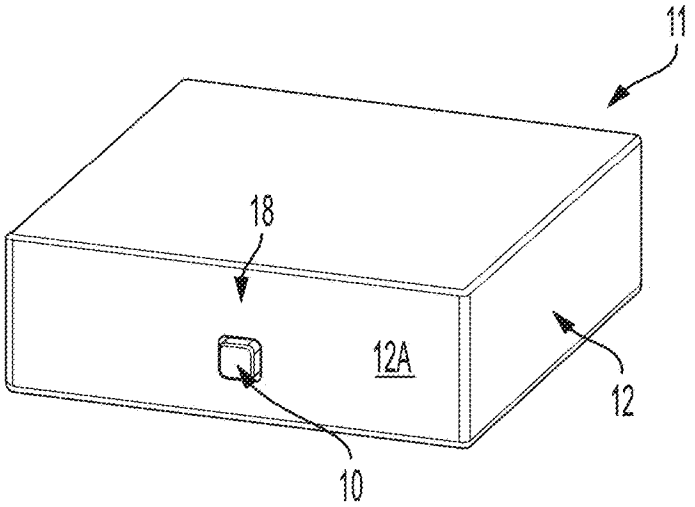
FIG. 1A is a perspective view of a product package with a locking mechanism according to embodiments of the present disclosure, the product package positioned in a secured closed position with the locking mechanism in the locked or unactuated position.
Figure 1C:
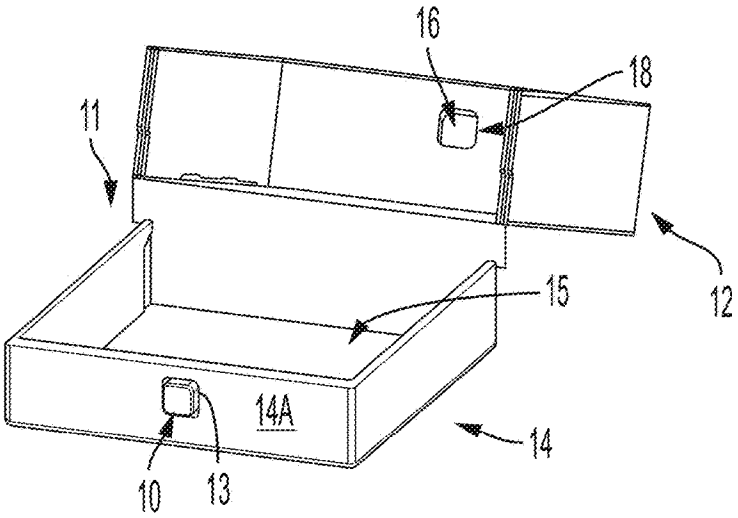
FIG. 1C is an perspective view of the product package with the locking mechanism of FIGS. 1A-1B of the present disclosure, the product package in an open position.

Embodiments of the present disclosure are directed to a locking mechanism 10 for a product package 11. FIGS. 1A-1C depict views of the locking mechanism 10 in various positions while installed on the product package 11. In some aspects, the product package 11 includes a top member 12, which may form a top of the product package 11, and a bottom member 14, which may form a bottom of the product package 11. The top member 12 and the bottom member 14 may be coupled together in a closed position that is secured (or locked) via the locking mechanism 10. In the closed position, for example as shown in FIG. 1A, the top member 12 may be locked or secured to the bottom member 14 such that the top member 12 and bottom member 14 may not separate from one another without moving the locking mechanism 10 from a locked or unactuated position to an unlocked or actuated position. The product package 11 may further have an open position (as shown in FIG. 1C), in which the top member 12 is uncoupled from and rotated away from the bottom member 14 such that an interior region 15 of the product package 11 is accessible. Though FIGS. 1A-1C depict the product package 11 as having a top member 12 that is positioned on top of a bottom member 14 in the closed position, in some aspects the product package may have a top member that may be positioned within a bottom member.

The top member 12 may include a wall 12A. The bottom member 14 may also include a wall 14A. The locking mechanism 10 may be secured in place on the bottom member 14, as shown in FIGS. 1A-1C on the wall 14A. The product package 11 may be moved from the open position (shown in FIG. 1C) to the closed position (shown in FIG. 1A) by rotating the top member 12 down towards the bottom member 14. The wall 14A and wall 12A may be aligned such that the locking mechanism 10 extends at least partially through an opening 16 (shown in FIGS. 1B, 1C) in the wall 12A of the top member 12 to secure (or lock) the top member 12 to the bottom member 14 in the closed position (as shown in FIG. 1A). The locking mechanism 10 may also extend through an opening in the wall 14A of the bottom member 14. As used herein, the term "closed position" means the product package (e.g. product package 11) cannot be moved from the closed position to the open position without actuation of a locking mechanism (e.g. locking mechanism 10). As described further below with reference to FIGS. 4A, 4B, the locking mechanism 10 can be actuated between a locked position and an unlocked position, for selectively uncoupling the top member 12 from the bottom member 14, by applying a force to a portion of the locking mechanism 10. In the locked position, the locking mechanism 10 may be retained in place by frictional engagement between the locking mechanism 10 and an edge surface 18 defining the opening 16 in the wall 12A of the top member 12 of the product package 11. Though FIGS. 1A-1C depict the locking mechanism 10 coupled to the bottom member 14 and optionally coupled to the top member 12 (i.e. when the product package 11 is in the closed position), in some embodiments the locking mechanism 10 may be coupled to a different location on the product package 11. For example, in some embodiments a product package may have the locking mechanism coupled to a top portion of the product package and optionally coupled to the bottom portion of the product package, for moving the product package between an open position and a closed position, without departing from the scope of this disclosure.

Figure 2:
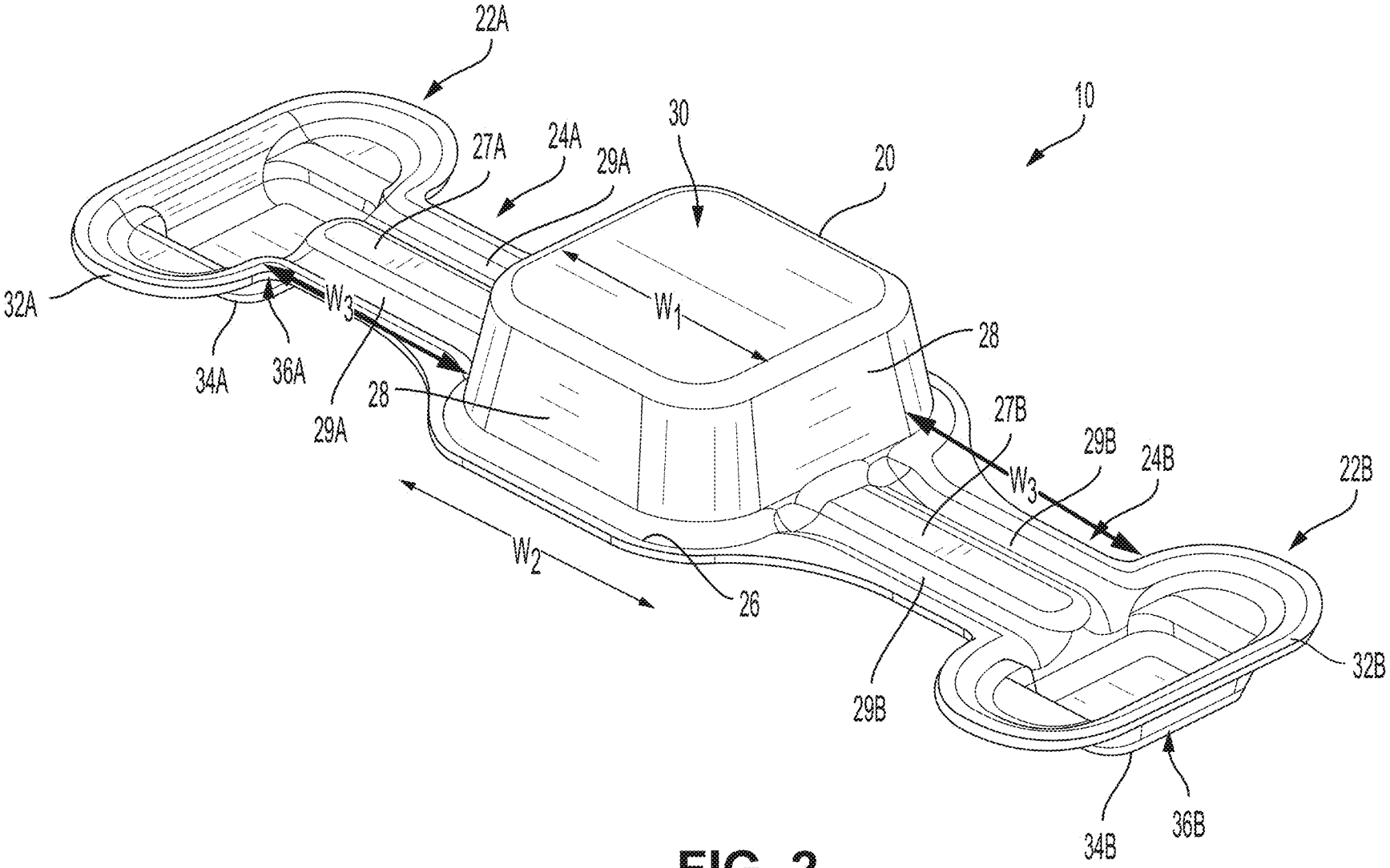
FIG. 2 is a top perspective view of a locking mechanism according to embodiments of the present disclosure.

In some embodiments, as illustrated in the top front perspective view of the locking mechanism 10 depicted in FIG. 2, the locking mechanism 10 may comprise a body portion 20, an end portion 22A connected to the body portion 20 via a neck portion 24A, and an end portion 22B connected to the body portion 20 via a neck portion 24B. The body portion 20 may include a base 26 from which side walls 28 project upwards to a top surface 30. The locking mechanism 10 may include respective ridges 27A, 27B which may extend between recesses 29A, 29B, respectively. The ridges 27A, 27B and recesses 29A, 29B may aid in providing strength and/or stiffness to the locking mechanism 10. For example, the ridges 27A, 27B and recesses 29A, 29B may aid in providing the locking mechanism 10 with sufficient structural support to repeatedly flex between an actuated position and an unflexed position without permanently deforming, thereby allowing the repeated actuated of the locking mechanism 10. More or fewer ridges and/or recesses may be used in embodiments of the locking mechanism 10. In some examples, top surface 30 may be positioned at a distance in a range of about 8 mm-24 above the base 26. In some embodiments, the top surface 30 may be between approximately 15 mm and approximately 17 mm apart from the base 26. While exemplary ranges are provided herein, such ranges are not limiting as the height the top surface 30 extends from the base 26 may be selected depending on the characteristics of the product package 11, for example but not limited to the material used for the product package 11 that may determine the thickness of the walls and/or flaps of the product package 11. In some embodiments, the body portion 20 may include a company logo and/or may be shaped into a company's logo. In some embodiments, the material defining the locking mechanism 10 may have a thickness of between about 0.5 mm and about 1.5 mm, including but not limited to having a thickness of about 1 mm.

In some embodiments, a width $W_1$ of the top surface 30 may be less than a width $W_2$ of the base 26 of the body portion 20, as defined by the slope of the side walls 28. The differences between the widths $W_1$ and $W_2$ may aid in manufacturing and/or the functionality of the locking mechanism 10. In some embodiments, the width $W_1$ of the top surface 30 may not differ from the width $W_2$ of the base 26, or in some embodiments the width $W_2$ may be less than the width $W_1$. In some embodiments, without limitation, the width $W_1$ of the top surface 30 may be in the range of about 20 mm to about 40 mm and the width $W_2$ of the base 26 may be in the range of about 30 mm to about 50 mm.

Figure 3:
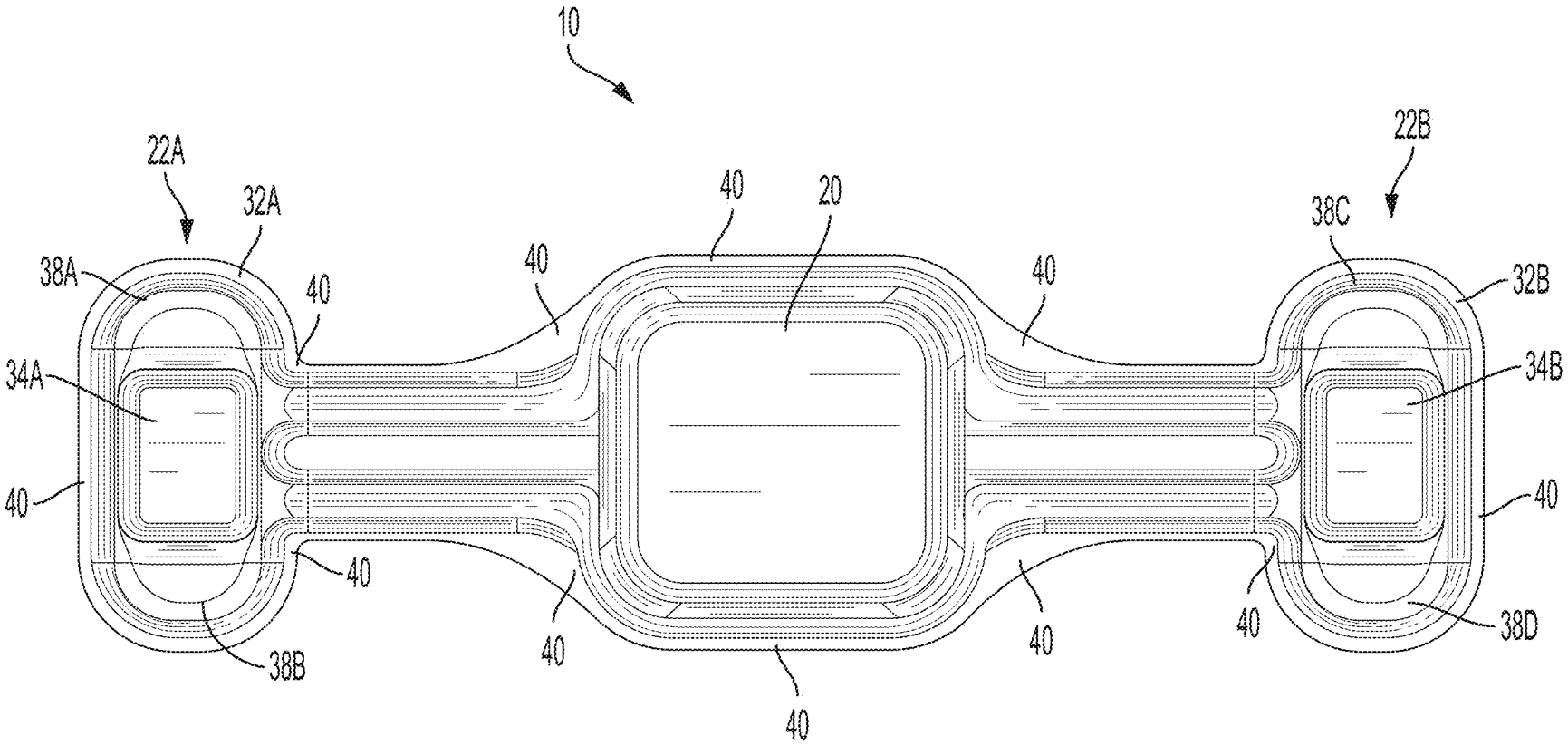
FIG. 3 is a front view of the locking mechanism of FIG. 2.

The neck portions 24A, 24B may each have a width of $W_3$. The amount each neck portion 24A, 24B, extends between the body portion 20 and the respectively end portions 22A, 22B may be between about 20 mm and about 40 mm, including for example but not limited between about 25 mm and about 30 mm. The width $W_3$ can aid in providing sufficient structural support for the locking mechanism 10 to repeatedly flex between an actuated and an unflexed position without permanently deforming, thereby allowing for repeated use of the locking mechanism 10. The end portion 22A includes a base 32A from which a projection 34A projects in a direction opposite the direction in which the body portion 20 projects. The end portion 22B includes a base 32B from which a projection 34B projects in the direction opposite the direction in which the body portion 20 projects. FIG. 3 depicts a bottom plan view of the locking mechanism 10 separate from the product package 11. As shown in FIG. 3, the projection 34A projects in a direction coming out of the page via sidewalls 36A (shown in FIG. 2) while the body portion 20 projects in a direction into the page via side walls 28 (shown in FIG. 2). The base 32A surrounds the projection 34A and may include tabs 38A, 38B that extend outwardly away from the projection 34A. Similarly, the end portion 22B includes a base 32B from which a projection 34B projects in a direction opposite the direction in which the body portion 20 projects. In other words, in viewing FIG. 3 the projection 34B projects in a direction coming out of the page via sidewalls 36B (shown in FIG. 2) while the body portion 20 projects in a direction into the page. The base 32B surrounds the projection 34B and may include tabs 38C, 38D that extend outwardly away from the projection 34B. In some embodiments, the projections 34A, 34B may be extend about 4 mm to about 12 mm, including ranges therein for example but not limited to including but not limited to extending about 8 mm to about 10 mm away from the respective bases 32A, 32B. The height of the projections 34A, 34B may be determined based on characteristics of the product package 11, for example but not limited to the material used for the product package 11 that may define the thickness of the walls and/or flaps of the product package 11.

The locking mechanism 10 also includes an outer perimeter or ledge 40 extending circumferentially around one or more of the body portion 20, the neck portions 24A, 24B, or the end portions 22A, 22B of the locking mechanism 10. The outer perimeter or ledge 40 may extend sufficiently to form a surface upon which a surface of the product package 11 may contact for retaining the locking mechanism 10 in place on the product package 11. In some embodiments, the outer perimeter or ledge 40 may extend about 1.5 mm to about 5 mm—from the body portion 20.

In some embodiments, the end portions 22A, 22B, the body portion 20, the outer perimeter or ledge 40, and the neck portions 24A, 24B may be integrally formed. However, the end portions 22A, 22B, body portion 20, outer perimeter or ledge 40, and/or neck portions 24A, 24B may be separately formed and coupled together by any suitable attachment means.

Figure 4A:
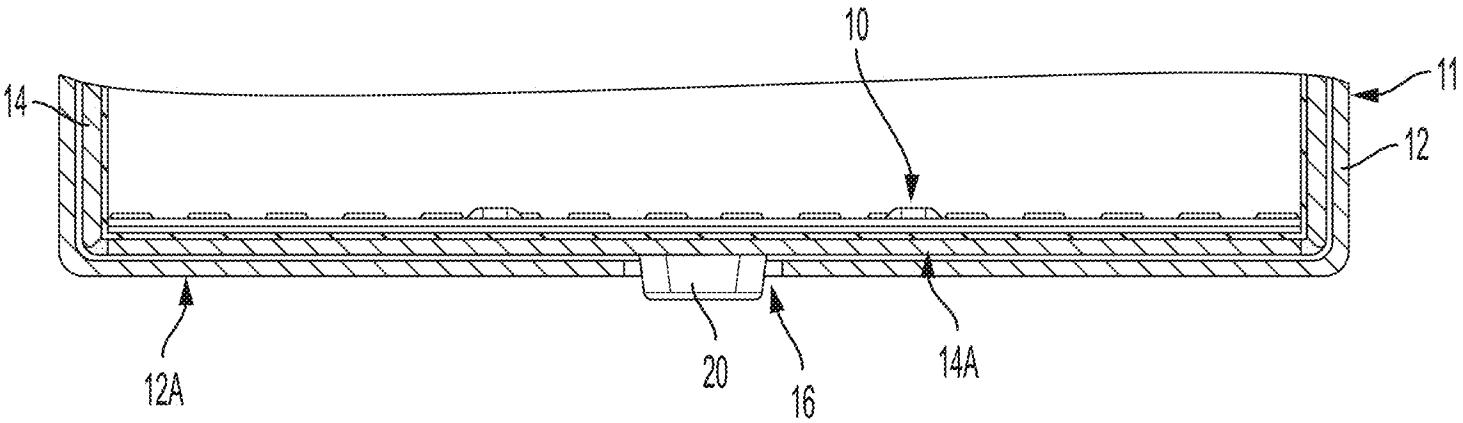
FIG. 4A is a top partial cross-sectional view of a product package in a closed position with a locking mechanism in the locked position, according to embodiments of the present disclosure.
Figure 4B:
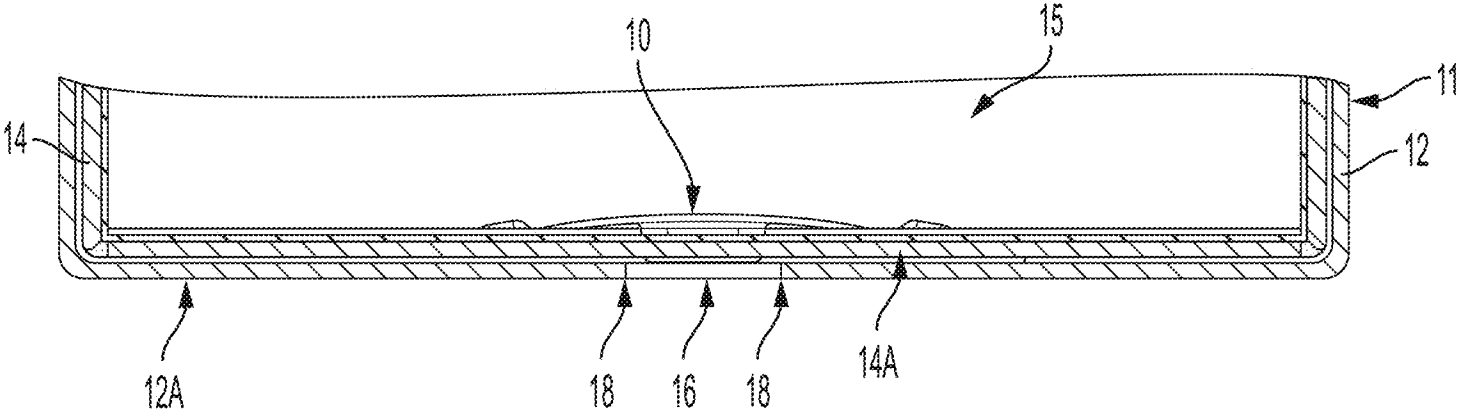
FIG. 4B is a top partial cross-sectional view of the product package in the closed position with the locking mechanism in the unlocked position, according embodiments of the present disclosure.

FIG. 4A depict a cross-sectional top view of the product package 11 showing the locking mechanism 10 in the locked position with the top member 12 of the product package 11 in a closed position relative to the bottom member 14. In the locked position, the locking mechanism 10 may be positioned such that the neck portions 24A, 24B are generally linearly aligned along a horizontal axis. As shown in FIG. 4A, in the locked position the body portion 20 extends through the opening 13 in the wall 14A of the bottom member 14 and also extends at least partially through the opening 16 in the wall 12A of the top member 12 for securing the top member 12 to the bottom member 14. In the locked position, the locking mechanism 10 may retain the product package 11 in the closed position by passing at least partially through the opening 16. In some aspects, at least a portion of the locking mechanism 10 may also contact the edge surface 18 of the opening in the product package 11 to aid in securing the top member 12 to the bottom member 14 by providing frictional engagement between the locking mechanism 10 and the top member 12. FIG. 4B depicts a cross-sectional top view of the product package 11 showing the locking mechanism 10 in the unlocked or actuated position with the top member 12 in a decoupled or unsecured position relative to the bottom member 14. In the unlocked or actuated position, the body portion 20 of the locking mechanism does not extend through the opening 16 in the wall (i.e. the wall 12A) of the top member 12, thereby permitting rotation of the top member 12 away from the bottom member 14 to open the product package 11.

As shown in FIG. 4B, to actuate the locking mechanism 10 from the locked to the unlocked position the body portion 20 may be pushed inwardly towards the interior region 15 of the product package 11. The body portion 20 may be pushed inwardly to a point that the body portion 20 no longer extends sufficiently through the opening 16 in the wall 12A such that the top member 12 is no longer coupled to the bottom member 14. By positioning the locking mechanism 10 in the actuated or unlocked position, the top member 12 may be decoupled from the bottom member 14. In some embodiments, the body portion 20 may extend at least partially through the opening 16 in the wall 12A in the actuated position. In some embodiments, the body portion 20 may not extend through the opening 16 in the wall 12A at all when in the actuated position. With the locking mechanism 10 in the actuated position, the top member 12 may be rotated away from the bottom member 14 into the open position. In the locked position (shown in FIG. 4A), the body portion 20 extends at least partially through the opening 16 in the wall 12A of the product package 11 to secure the top member 12 to the bottom member 14. In some embodiments, as shown in FIG. 4A, the body portion 20 may extend through the opening 16 a sufficient amount to contact the edges of the opening 16 to retain the top member 12 in place coupled to the bottom member 14. The amount the body portion 20 extends through the opening 16 may vary depending on the size, shape, and orientation of the opening 16 and the locking mechanism 10. Upon removal of force from the body portion 20, the locking mechanism 10 may return to the locked or unactuated position. In other words, the locking mechanism 10 may be biased to the locked position. Thus, the locking mechanism 10 may remain in the locked position until a force or pressure is applied to the locking mechanism 10, i.e. the body portion 20, thereby moving the locking mechanism 10 to the unlocked or actuated position.

Figure 5A:
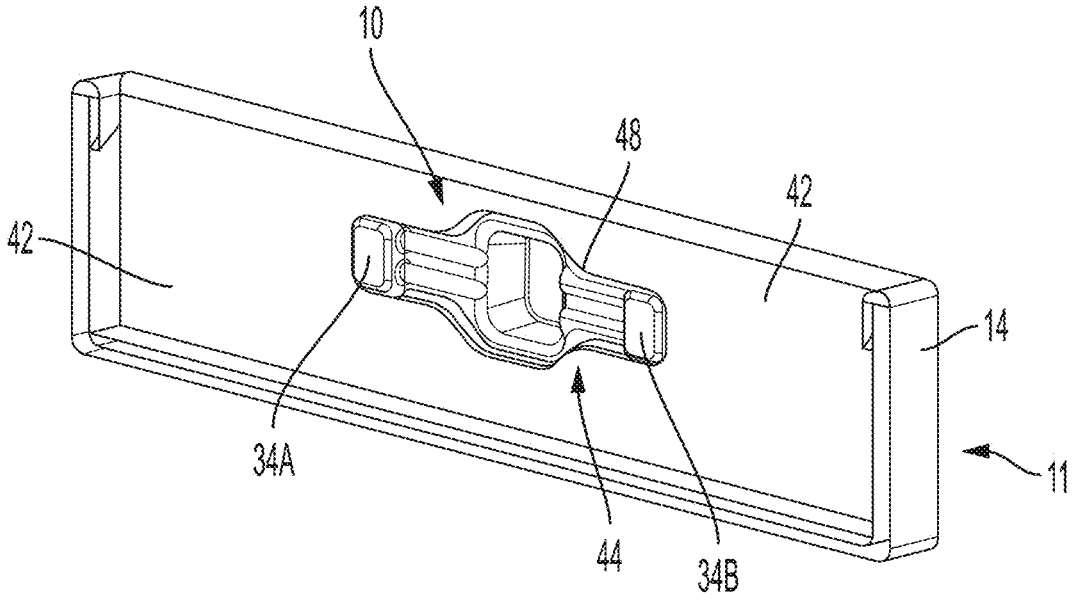
FIG. 5A is a rear perspective view of the locking mechanism of the product package of FIGS. 4A, 4B in the locked or unactuated position, according to embodiments of the present disclosure.
Figure 5B:
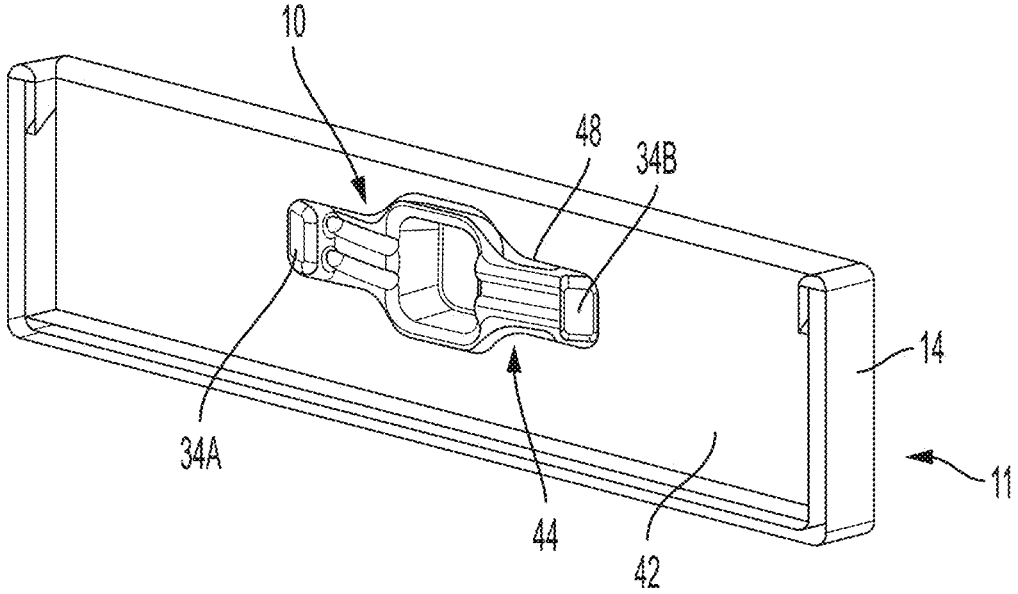
FIG. 5B is a rear perspective view of the locking mechanism of the product package of FIGS. 4A, 4B in the unlocked or actuated position, according to embodiments of the present disclosure.

FIG. 5A depicts a rear view of the product package 11 with the locking mechanism 10 in the locked position while FIG. 5B depicts the same view with the locking mechanism 10 in the actuated position. As shown in FIGS. 5A, 5B the locking mechanism 10 may be secured in place on the product package 11 with a front surface of the locking mechanism 10 positioned against an inner surface of the wall 14A (not visible in FIGS. 5A, 5B due to placement of the flap member 42) the product package 11 and with the body portion 20 extending through the opening 13 in the wall 14A. A flap member 42 of the product package 11 may fold down towards the wall 14A of the product package 11. The flap member 42 may include a cutout 44 shaped and sized to generally correspond to the locking mechanism 10 such that the locking mechanism 10 is sandwiched and secured in place between the flap member 42 and the wall 14A. In some aspects, the locking mechanism 10 may be retained in place between the flap member 42 and the wall 14A by the ledge 40 sandwiched between the flap member 42 and the wall 14A. In some embodiments, as shown in FIGS. 5A, 5B, the locking mechanism 10 may be secured in place without adhesive or other additional securing features. For example, an edge region 48 of the flap member 42 may contact the ledge 40 of the locking mechanism 10 to aid in securing the locking mechanism 10 in place. The projections 34A, 34B also aid in securing the locking mechanism 10 in place between the wall 14A the flap member 42 by extending beyond the flap member 42. The locking mechanism 10 may be sufficiently secured in its position between the wall 14A and the flap member 42 such that the locking mechanism 10 is retained in place when a force is applied to the body portion 20 to actuate the locking mechanism 10 from the locked position (shown in FIG. 5A) to the actuated position (shown in FIG. 5B) for uncoupling the top member 12 from the bottom member 14 for opening the product package 11. As shown in FIG. 5B, the locking mechanism 10 may be flexible enough to repeatedly flex between the locked position and the actuated (or unlocked) position. In some embodiments the locking mechanism 10 may be retained in place by other means, including but not limited to adhesives, mechanical features, hook and loop fasteners, or any other suitable means for securing the locking mechanism 10 in position.

Figure 6:
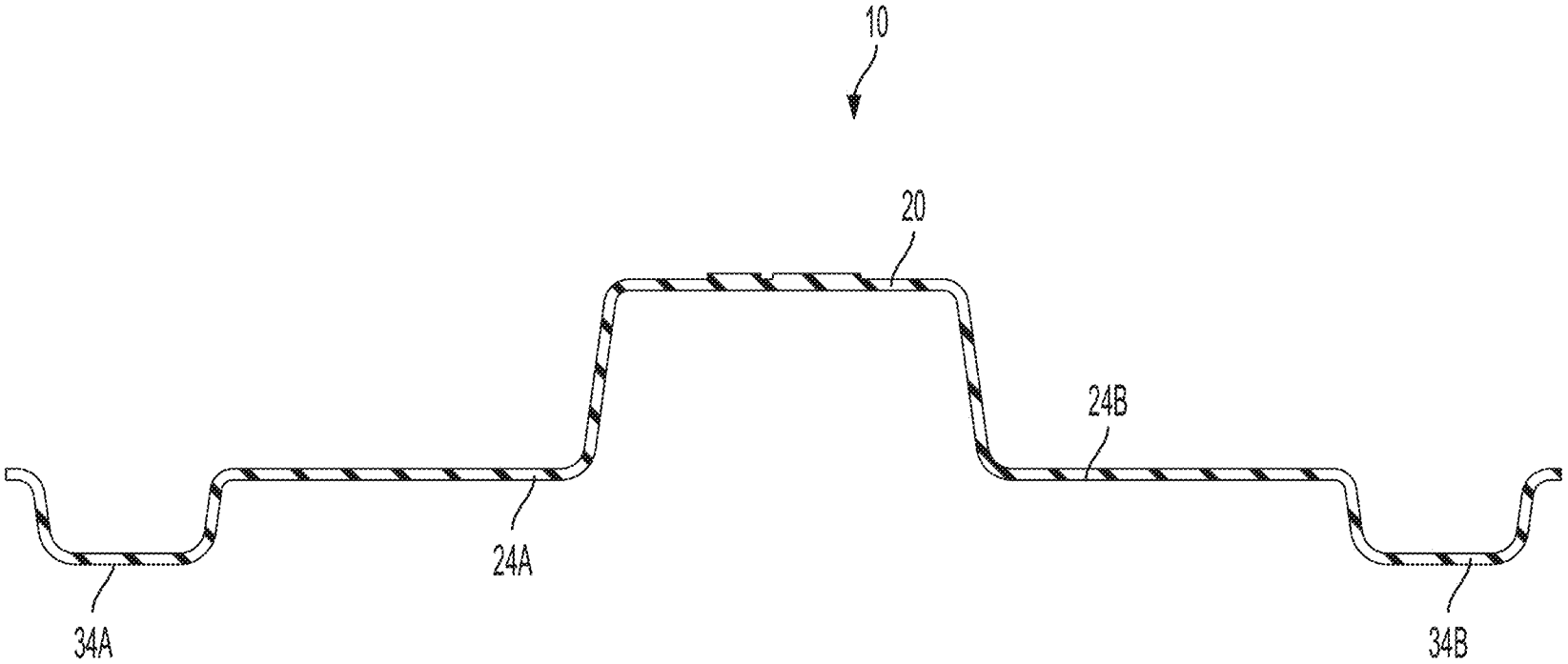
FIG. 6 is a cross-sectional top view of a locking mechanism of a product package, according to embodiments of the present disclosure.

FIG. 6 depicts a cross-sectional top view of an embodiment of a locking mechanism according to aspects of the present disclosure, for example, but not limited to, locking mechanism 10, including the body portion 20, the neck portions 24A, 24B, the end portion 22A, 22B, and the projections 34A, 34B.

In some embodiments, the locking mechanism 10 may be formed of a fiber material, including but not limited to molded fiber material. The locking mechanism may be formed of a sustainable fiber material, such as a material comprising natural or plant derived fibers, including by example only with no intention to be limiting sustainable or rapidly renewing natural or plant derived fibers (e.g., bamboo, bagasse, etc.). In some embodiments, the fiber material of the locking mechanism 10 may include, but is not limited to including, recycled paper, non-recycled paper, wood, sisal, flax, hemp, jute, kenaf, cotton, cereal straws, bamboo, and/or bagasse, including combinations thereof. In some embodiments, the locking mechanism 10 may be formed from a slurry of materials, including but not limited to plant derived fibers, water, and/or binding ingredients. In some embodiments, the materials defining the locking mechanism may be biodegradable, compostable, and/or recyclable.

The locking mechanism 10 may be formed of fiber materials that have been molded into the shape of a locking mechanism. In some embodiments, the locking mechanism 10 may be formed by molding, pressing, and/or die cutting processes. In some embodiments, the locking mechanism 10 may be manufactured by molding, for example by mixing a water/fiber slurry, pumping the slurry into a forming station, drawing the slurry through a screen so as to trap the fiber material of the slurry onto the screen. The fiber material, now on the screen, may be pressed in molds that are the form factor of the desired product. Heat and pressure may be applied to the molds so that the water is pressed and evaporated out of the fibers. The product may be removed from the molds dry and ready for shipping. In some aspects, the product may be die cut following the molding process.

In some examples of product packages and locking mechanisms contemplated in the present disclosure, the similar composition of the locking mechanism 10 to the materials used in packaging (e.g. corrugated fiberboard and paperboard) may allow for the entire product package 11, including the locking mechanism 10, to be recycled, added to compost, and/or permitted to biodegrade, in its entirety without the need for separation from one another. For example, without having to separate the locking mechanism 10 from the remainder of the product package 11 which can increase the likelihood of recycling or otherwise reduce the likelihood of the product package 11 and/or the locking mechanism 10 ending up in a landfill or causing contamination of a recycling plant by including materials that should have been separated from one another prior to recycling. Furthermore, the manufacturing of the locking mechanism 10 from the fiber material, i.e. by a molding production method, may provide for variations of structures and features, including size, shape, and orientation of the locking mechanism 10, depending on the desired design and/or necessities of the locking mechanism 10 based on the material used for the remainder of the product package 11 (e.g. walls of the product package 11).

As described above, the locking mechanism 10 may be formed of a fiber material, which, due to the molding process, may be customized so as to be formed into a unique shape. The molding process may also provide for the locking mechanism 10 being manufactured using an automated process. In addition, the relative small size of the locking mechanism 10 can provide for multiple pieces being produced on a single tool, and subsequently providing rapid reproducibility of the locking mechanism. The molded fiber material may vary in thickness and may be pliable in nature, thereby providing functionality that can be used in many different situations. In particular, the molded fiber material allows for the locking mechanism 10 to be cycled between the actuated (or unlocked) position and the unactuated (or locked) position multiple times without the need to be replaced. In other words, in addition to being biodegradable, recyclable and/or compostable, the locking mechanism 10 may also be reusable thereby eliminating waste. The locking mechanism 10 may not include plastic.

Moreover, the locking mechanism 10 may be integrated into a preexisting product package or may be formed as a separate structure within other packaging materials (e.g., product package 11). For example, the locking mechanism 10 may allow for the closure of a product package 11 having a single piece. Alternatively, the locking mechanism 10 may attach multiple pieces of a product package 11. Additionally, as described above, the locking mechanism 10 may be designed as multiple pieces depending on packaging needs.

In some embodiments, the thickness of the molded fiber material defining the locking mechanism (e.g. locking mechanism 10) may be selected to adjust for mass requirements of a particular product package 11. For example, the locking mechanism 10 may be adjusted to have a stronger lock when necessary and/or may be adjusted to accommodate for varying space requirements between packaging components where necessary. In addition, the pliable nature of the molded fiber material combined with the aforementioned features may also determine the tightness or security of the lock between elements of the locking mechanism 10, which may be selected to correspond with a desired user experience when unboxing the product package 11. This ability to control the tightness or security of the lock between elements of the locking mechanism 10 provides for a level of control that is not available when using other materials. Furthermore, the molded fiber material allows for the locking mechanism 10 to be produced and integrated within the product package 11 without the need for complex injection molded tooling.

Figure 7:
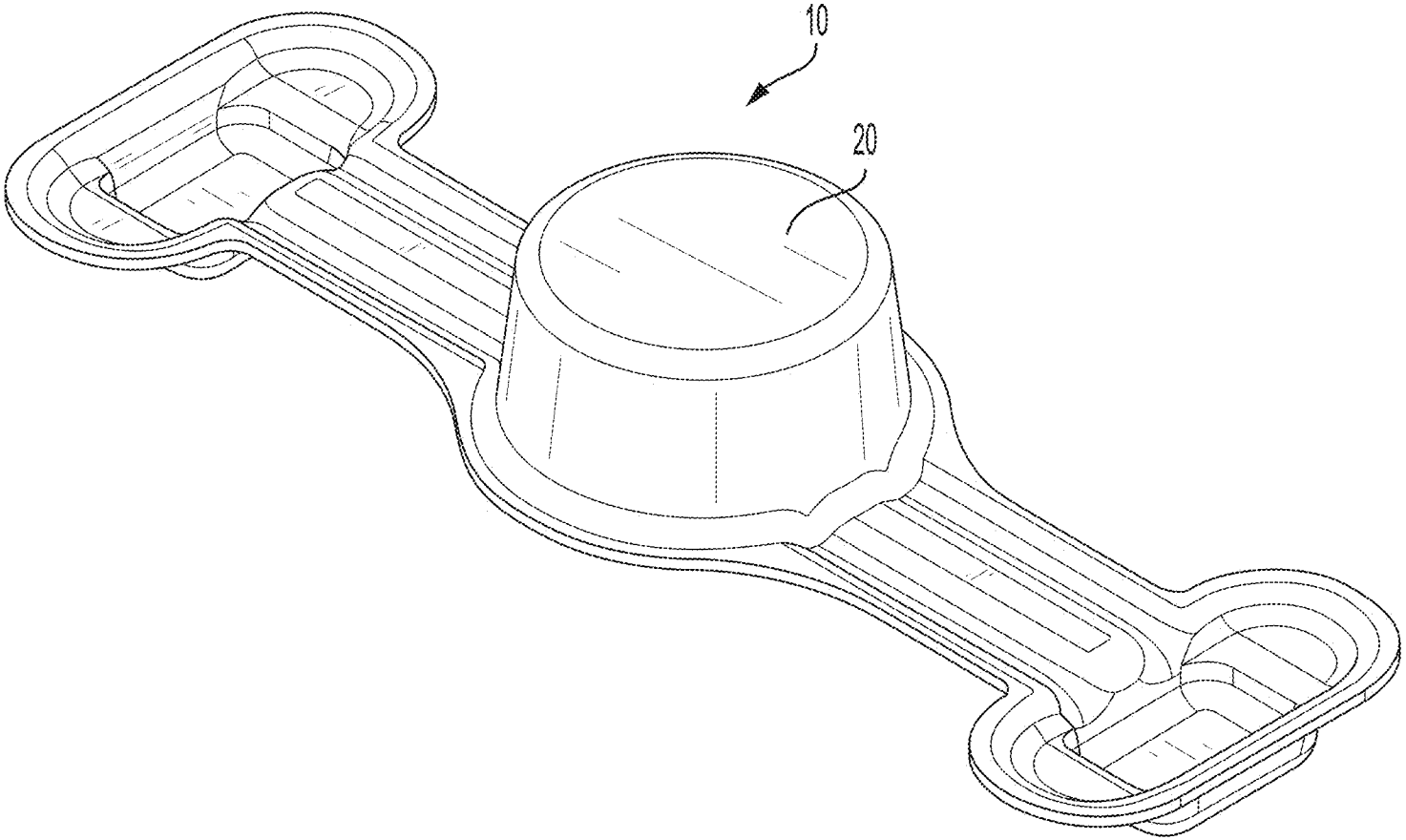
FIG. 7 is a perspective view of a locking mechanism according to embodiments of the present disclosure.

While the locking mechanism 10 is illustrated in use with a product package 11 being a rectangular box, the locking mechanism 10 is not so limited and may be used in a product package of varying shapes and sizes. Moreover, the locking mechanism 10 may be positioned in any suitable location on the product package 11, not necessarily on the bottom member as shown in FIGS. 1A-1C. Similarly, the locking mechanism 10 may vary in size and shape from the embodiments disclosed herein without departing from the scope of the present disclosure. For example, the body portion 20 of the locking mechanism 10 may be rectangular in shape, circular in shape, triangular in shape, or any other suitable shape. For example, an embodiment of the present disclosure is shown in FIG. 7 in which the body portion 20 of the locking mechanism 10 has a circular shape.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

In some embodiments, a locking mechanism or packaging product is provided according to one or more of the following examples:

Example #1: A locking mechanism for a product package may include a body portion that is receivable within a surface of the product package. The locking mechanism may also include a pair of end portions, as well as a first neck portion positioned between the body portion and a first end portion of the pair of end portions. The locking mechanism may also include a second neck portion positioned between the body portion and a second end portion of the pair of end portions. The locking mechanism may have locked position in which at least a portion of the locking mechanism extends through an opening in a wall of a product package for retaining the product package in a closed position. The locking mechanism may also have an actuated position in which the locking mechanism does not extend through the opening in the wall of the product package for permitting the product package to be moved to an open position. The locking mechanism may be biased to the locked position and may comprises a fiber material.

Example #2: The locking mechanism of Example #1, further featuring the locking the first and second neck portions being generally linearly aligned along a horizontal axis when the locking mechanism is in the locked position. The locking mechanism may be flexible such that in the actuated position first and second neck portions are not generally linearly aligned along the horizontal axis.

Example #3: The locking mechanism of any of Examples #1-#2, further featuring a top surface of the body portion of the locking mechanism extending entirely through the opening in the wall of the product package when the locking mechanism is in the locked position.

Example #4: The locking mechanism of any of Examples #1-#3, further featuring the fiber material being a molded fiber material.

Example #5: The locking mechanism of any of Examples #1-#4, further featuring the fiber material being a natural fiber.

Example #6: The locking mechanism of any of Examples #1-#5, further featuring the fiber material being at least one of paper, wood pulp, hemp or bamboo.

Example #7: A product package assembly may include a locking mechanism and a product package. The locking mechanism may include a body portion and a pair of end portions. The locking mechanism may also include a first neck portion positioned between the body portion and a first end portion of the pair of end portions, as well as a second neck portion positioned between the body portion and a second end portion of the pair of end portions. The product package may include a first member including a first wall, and a second member including a second wall. The first member may be coupleable to the second member in a closed position via the locking mechanism. The product package assembly may include a closed position in which the locking mechanism is in a locked position. The body portion may extend at least partially through an opening in the first wall of the first member for securing the first member to the second member in a closed position when the locking mechanism is in the locked position. The locking mechanism may also have an unlocked or actuated position in which the body portion does not extend through the opening in the first wall of the first member such that first wall and second wall are uncoupled from one another. The locking mechanism may include a fiber material.

Example #8: The product package assembly of Example #7, further featuring the locking mechanism being biased to the locked position.

Example #9: The product package assembly of any of Examples #7-#8, further featuring the locking mechanism being repeatedly moveable between the locked position and the actuated position.

Example #10: The product package assembly of any of Examples #7-#9, further featuring the first neck portion having at least one ridge and at least one recess.

Example #10: The product package assembly of any of Examples #7-#9, further featuring that a top surface of the body portion of the locking mechanism extends through an opening in the second wall of the second member in the locked position.

Example #11: The product package assembly of any of Examples #7-#10, further featuring the locking mechanism being retained in place on the product package without the use of an adhesive.

Example #12: The product package assembly of any of Examples #7-#11, further featuring that the fiber material comprises a molded fiber material.

Example #14: The product package assembly of any of Examples #7-#13, further featuring that the fiber material comprises a natural fiber.

Example #15: The product package assembly of any of Examples #7-#14, further featuring that the natural fiber comprises a plant fiber.

Example #16: A method of opening a product package may include providing the product package comprising a first member having an opening in a wall of the first member, and a second member that is coupleable to the first member. The product package may also include a locking mechanism formed of a molded fiber material for coupling the first member and the second member in a closed position. The locking mechanism may further include a body portion, a pair of end portions, a first neck portion positioned between the body portion and a first end portion of the pair of end portions, and a second neck portion positioned between the body portion and a second end portion of the pair of end portions. The method includes applying a force to the body portion of the locking mechanism for forcing the locking mechanism from a locked position in which the first member is coupled to the second member in the closed position, to an actuated position in which the first member is uncoupled from the second member for rotating the first member away from the second member to position the product package in an open position.

Example #17: The method of Example #16 further featuring, rotating the first member towards the second member such that the opening in the wall of the first member is aligned with the body portion of the locking mechanism. The method also includes removing a force from the locking mechanism for automatically positioning the locking mechanism in the locked position wherein the body portion of the locking mechanism at least partially extends through the opening in the wall of the first member such that the first member and second member are secured together in the closed position.

Example #18: The method of any of Examples #16-#17, further featuring the step of applying a force to the locking mechanism for forcing a body portion of the locking mechanism from a locked position in which the first member is coupled to the second member in the closed position, further comprising applying the force to the body portion of the locking mechanism for moving the body portion of the locking mechanism such that it no longer extends at least partially through the opening in the wall such that the first member is uncoupled from the second member.

Example #19: The method of any of Examples #16-#18, further featuring the molded fiber material comprising a plant fiber.

Example #20: The method of any of Examples #16-#19, further featuring the molded fiber material comprises at least one of paper, wood pulp, hemp, or bamboo.

What is claimed is:

1. A product package assembly comprising:

a product package including a first wall;

a locking mechanism coupled to a second wall of the product package, the locking mechanism further comprising:

a body portion having a top surface and a plurality of side walls, the body portion being receivable within a surface of the product package;

a pair of end portions;

a first neck portion positioned between the body portion and a first end portion of the pair of end portions;

a second neck portion positioned between the body portion and a second end portion of the pair of end portions;

wherein the locking mechanism is positionable in a locked position in which at least a portion of the top surface of the locking mechanism extends through an opening in the first wall of the product package for retaining the product package in a closed position, and wherein the locking mechanism is positionable in an actuated position in which the locking mechanism does not extend through the opening in the first wall of the product package for permitting the product package to be moved to an open position, the locking mechanism being biased to the locked position; and wherein the locking mechanism comprises a fiber material.

2. The product packaging assembly of claim 1, wherein, in the locked position the first and second neck portions are generally linearly aligned along a horizontal axis; and wherein, the locking mechanism is flexible such that in the actuated position the first and second neck portions are not generally linearly aligned along the horizontal axis.

3. The product package assembly of claim 1, wherein in the locked position the top surface of the body portion of the locking mechanism extends beyond a front surface of the first wall of the product package.

4. The product package assembly of claim 1, wherein the fiber material is a molded fiber material.

5. The product package assembly of claim 1, wherein the fiber material comprises a natural fiber.

6. The product package assembly of claim 5, wherein the natural fiber comprises at least one of paper, wood pulp, hemp, bagasse, straw or bamboo.

7. A product package assembly comprising:

a locking mechanism comprising:

a body portion having a top surface and a plurality of side walls;

a pair of end portions;

a first neck portion positioned between the body portion and a first end portion of the pair of end portions; and a second neck portion positioned between the body portion and a second end portion of the pair of end portions;

a product package comprising:

a first member including a first wall;

a second member including a second wall, the first member coupleable to the second member in a closed position via the locking mechanism;

wherein the locking mechanism is coupled to the second wall of the product package, and wherein product package assembly is positionable in a closed position in which the locking mechanism is in a locked position in which the top surface of the body portion extends at least partially through an opening in the first wall of the first member for securing the first member to the second member in a closed position;

wherein the locking mechanism is positionable in an actuated position in which the top surface of the body portion does not extend through the opening in the first wall of the first member such that first wall and second wall are uncoupled from one another; and wherein the locking mechanism comprises a fiber material.

8. The product package assembly of claim 7, wherein the locking mechanism is biased to the locked position.

9. The product package assembly of claim 7, wherein the locking mechanism is repeatedly moveable between the locked position and the actuated position.

10. The product package assembly of claim 7, wherein the first neck portion further comprises at least one ridge and at least one recess.

11. The product package assembly of claim 7, wherein the top surface of the body portion of the locking mechanism extends beyond a front surface of the second wall of the second member in the locked position.

12. The product package assembly of claim 7, wherein the locking mechanism is retained in place on the product package without the use of an adhesive.

13. The product package assembly of claim 7, wherein the fiber material comprises a molded fiber material.

14. The product package assembly of claim 7, wherein the fiber material comprises a natural fiber.

15. The product package assembly of claim 14, wherein the natural fiber comprises a plant fiber.

16. A method of opening a product package comprising:

providing the product package comprising:

a first member having an opening in a wall of the first member;

a second member that is coupleable to the first member;

a locking mechanism coupled to the second member and formed of a molded fiber material for coupling the first member and the second member in a closed position, the locking mechanism further comprising:

a body portion having a top surface and a plurality of side walls;

a pair of end portions;

a first neck portion positioned between the body portion and a first end portion of the pair of end portions;

a second neck portion positioned between the body portion and a second end portion of the pair of end portions;

applying a force to the body portion of the locking mechanism for forcing the locking mechanism from a locked position in which the body portion at least partially extends through the opening in the wall of the first member, to an actuated position in which the body portion does not extend through the opening in the wall of the first member such that first member is uncoupled from the second member for rotating the first member away from the second member to position the product package in an open position, wherein the locking portion comprises a fiber material.

17. The method of claim 16, further comprising:

rotating the first member towards the second member such that the opening in the wall of the first member is aligned with the body portion of the locking mechanism; and removing a force from the locking mechanism for automatically positioning the locking mechanism in the locked position wherein the body portion of the locking mechanism at least partially extends through the opening in the wall of the first member such that the first member and second member are secured together in the closed position.

18. The method of claim 16, wherein the step of applying a force to the locking mechanism for forcing a body portion of the locking mechanism from a locked position in which the first member is coupled to the second member in the closed position, further comprises:

applying the force to the body portion of the locking mechanism for moving the body portion of the locking mechanism such that it no longer extends at least partially through the opening in the wall such that the first member is uncoupled from the second member.

19. The method of claim 16, wherein the molded fiber material comprises a plant fiber.

20. The method of claim 19, wherein in the plant fiber comprises at least one of paper, wood pulp, hemp, bagasse, straw, or bamboo.

21. The product package assembly of claim 1, wherein the top surface of the body portion has a first width that is less than a second width of a base of the body portion.

22. The product package assembly of claim 21, wherein in the locked position at least one side wall of the plurality of side walls of the locking mechanism contacts a surface defining the opening in the first wall of the product package for aiding in retaining the product package in a closed position.

23. The product package assembly of claim 7, wherein the top surface of the body portion has a first width that is less than a second width of a base of the body portion.

24. The product package assembly of claim 23, wherein in the locked position at least one side wall of the plurality of side walls contacts a surface defining the opening in the first wall of the product package for aiding in retaining the product package in a closed position.

25. The product package assembly of claim 1, wherein the locking mechanism is retained in place between a second wall of the product package and a flap member of the product package.

26. The product package assembly of claim 12, wherein the locking mechanism is positioned in place between the second wall and a flap member.

* * * * *